4/1/80 OR 4,196,094

United States Patent [19]

Johnson et al.

[11] 4,196,094

[45] Apr. 1, 1980

[54] REMOVING DEPOSITS FROM SURFACES IN WOOD PULP PROCESSING APPARATUS

[75] Inventors: Howard D. Johnson; Kenneth J. Snyder, both of Duncan, Okla.

[73] Assignee: Halliburton Company, Duncan, Okla.

[21] Appl. No.: 972,308

[22] Filed: Dec. 22, 1978

[51] Int. Cl.[2] ..... C11D 7/54

[52] U.S. Cl. ..... 252/103; 252/95; 252/156; 134/2; 134/42

[58] Field of Search ..... 252/95, 103, 156; 134/2, 42

[56] References Cited

U.S. PATENT DOCUMENTS

| | | | |
|---|---|---|---|
| 691,671 | 1/1902 | Sjoo et al. | 252/103 |
| 3,454,427 | 7/1969 | Suzuki et al. | 252/95 X |
| 3,697,431 | 10/1972 | Summerfelt | 252/103 |

*Primary Examiner*—Mayer Weinblatt

*Attorney, Agent, or Firm*—Thomas R. Weaver; John H. Tregoning; C. Clark Dougherty, Jr.

[57] ABSTRACT

Methods for removing deposits from surfaces in wood pulp processing apparatus are provided wherein the deposits are contacted with compositions comprised of aqueous solutions of alkali metal hypochlorites.

8 Claims, No Drawings

REMOVING DEPOSITS FROM SURFACES IN WOOD PULP PROCESSING APPARATUS

In the processing of wood pulp such as in the making of paper, deposits are often formed on surfaces in processing apparatus composed of lignosulfonates, cellulose, lignins and other components found in wood pulp. For example, in the process of making pulp from wood for the making of paper, wood is digested in an aqueous solution usually containing sodium hydroxide, sodium sulfide, sodium carbonate and sodium sulfate. During the digesting process, the lignin and other noncellulose portions of the wood are cleaved and dissolved by this solution thus leaving an insoluble wood pulp. At this point the solution is termed black liquor.

When the black liquor is separated from the pulp, the liquor is passed through a series of evaporators where water is evaporated from the liquor leaving it in a less dilute state. Each evaporator is a vertical heat exchanger usually consisting of metal tubes surrounded by a metal shell. The liquor is passed through the tubes from bottom to top while steam is passed around the tubes inside of the shell. As the liquor travels up the tubes, some of the water in the liquor is turned into steam. This steam leaves the evaporator and is passed to a subsequent evaporator where it is used to heat concentrated black liquor for further concentration.

Due to the foaming tendency of the black liquor, portions are carried with the steam into the shell of the subsequent evaporator. Once within the shell, the liquor dries into a hard, brittle deposit consisting of lignosulfonates, cellulose, lignins, and other components of the digesting solution. The removal of such a deposit has been previously done by mechanical removal methods.

By the present invention methods and chemical compositions for removing such deposits are provided. The methods of the invention are simple and economical to carry out as compared to heretofore used methods.

The compositions of this invention for removing deposits from surfaces in wood pulp processing apparatus are comprised of aqueous solutions of alkali metal hypochlorites. A preferred such composition contains one or more alkali metal hypochlorites present in an amount in the range of from about 1% to about 10% by weight of the composition. Most preferably, the alkali metal hypochloriate compound or compounds are present in the composition in an amount of about 5% by weight.

Preferred alkali metal hypochlorites for use in accordance with the present invention are sodium hypochlorite, potassium hypochlorite and mixtures of such compounds, with sodium hypochlorite being the most preferred.

Depending upon the particular wood pulp processing deposit to be removed, an alkali metal hydroxide can be combined with the above-described composition to increase the pH of the composition and more efficiently remove the deposits. Of the alkali metal hydroxides which can be used, sodium hydroxide, potassium hydroxide and mixtures thereof are preferred with sodium hydroxide being the most preferred. When used, the alkali metal hydroxide is preferably present in the composition in an amount in the range of from about 0.05% to about 30% by weight of the composition, most preferably in an amount of about 2% by weight of the composition.

When a composition of the present invention of the type described above is brought into contact with wood pulp processing deposits, the deposits are dissolved thereby. In carrying out the methods of the present invention, a composition of the type described above is brought into contact with the deposits to be removed for a period of time effective to dissolve the deposits. The temperature of the composition during the contact can be in the range of from ambient temperature to the temperature at which the composition boils. Preferably the temperature of the composition is maintained at about 125° F. during the contact.

The compositions of the invention are preferably circulated over the surfaces containing the deposits to be removed, but the compositions can also be brought into contact with the deposits in a static condition.

In the most preferred method of the present invention, a composition comprised of an aqueous solution containing about 5% by weight sodium hypochlorite and about 2% by weight sodium hydroxide is brought into contact with the deposits to be removed by circulating the composition over the surfaces containing the deposits at a temperature of 125° F. for a period of time sufficient to dissolve the deposits.

In order to more clearly illustrate the present invention, the following examples are given.

EXAMPLE 1

In the laboratory, a one gram portion of a deposit removed from a black liquor evaporator of a paper mill is placed in a container followed by 50 mls. of an aqueous solution containing 5% by weight sodium hypochlorite and 2% by weight sodium hydroxide. The aqueous solution is maintained in contact with the deposit for a period of time of 6 hours at a temperature of 125° F. At the end of the 6-hour time period, 0.7 grams of the one gram portion of the deposit is dissolved by the solvent.

EXAMPLE 2

A number of aqueous solutions containing various chemicals are tested to determine their ability to dissolve deposits found in wood pulp processing apparatus. One gram portions of a deposit removed from a black liquor evaporator of a paper mill are placed in containers followed by 50 mls. of the various aqueous solutions given in Table I below. Each of the solutions is maintained in contact with the deposit for the period of time and at the temperature given in Table I. The quantities of deposit dissolved by each of the solutions is determined and expressed in weight percent in Table I.

TABLE I

COMPARISON OF DISSOLUTION ABILITY OF VARIOUS SOLVENTS ON BLACK LIQUOR EVAPORATOR DEPOSITS

| Solvent Used | Concentration by Weight of Solution | Solvent Temp. | Contact Time Hrs. | Deposit Solubility, % by Weight |
|---|---|---|---|---|
| Aqueous Solution of NaOH | 5% NaOH | Boiling | 24 Hrs. | 15 |

TABLE I-continued

COMPARISON OF DISSOLUTION ABILITY OF VARIOUS SOLVENTS ON BLACK LIQUOR EVAPORATOR DEPOSITS

| Solvent Used | Concentration by Weight of Solution | Solvent Temp. | Contact Time Hrs. | Deposit Solubility, % by Weight |
|---|---|---|---|---|
| Aqueous Solution of NaOH | 10% NaOH | Boiling | 24 Hrs. | 27 |
| Aqueous Solution of NaOH | 20% NaOH | Boiling | 24 Hrs. | 13 |
| Aqueous Solution of NaOH | 30% NaOH | Boiling | 24 Hrs. | 4 |
| Aqueous Solution of NaOH and NaS | 10% NaOH and 5% NaS | Boiling | 24 Hrs. | 1 |
| Aqueous Solution of NaOH and $NaBrO_3$ | 10% NaOH and 3% $NaBrO_3$ | 150° F. | 24 Hrs. | 6 |
| Aqueous Solution of NaOH and $NaNO_2$ | 10% NaOH and 3% $NaNO_2$ | 150° F. | 24 Hrs. | 0 |
| Aqueous Solution of HI | 5% HI | 150° F. | 24 Hrs. | 32 |
| Aqueous Solution of $H_2SO_4$ | 10% $H_2SO_4$ | 150° F. | 24 Hrs. | 25 |
| Aqueous Solution of Boiling 5% by Weight NaOH for 24 Hrs. Followed by Aqueous Solution of Formic Acid | 10% Formic Acid | 190° F. | 6 Hrs. | 48 |
| Aqueous Solution of Boiling 5% by Weight NaOH and 2% by Weight $KMnO_4$ Followed by Aqueous Solution of Formic Acid | 10% Formic Acid | 190° F. | 6 Hrs. | 34 |
| Aqueous Solution of Boiling 20% by Weight NaOH Followed by Aqueous Solution of Formic Acid | 10% Formic Acid | 190° F. | 6 Hrs. | 34 |
| Aqueous Solution of NaClO and NaOH | 5% NaClO and 2% NaOH | 125° F. | 6 Hrs. | 70 |

From Table I it can readily be seen that a composition of the present invention containing 5% by weight sodium hypochlorite and 2% by weight sodium hydroxide is much more effective in dissolving the deposit than the other solutions tested.

EXAMPLE 3

Scale removed from a black liquor evaporator of a paper mill is used to determine the solubility of the scale in various aqueous alkali metal hypochlorite solutions with and without alkali metal hydroxides. A given amount of the scale is weighted to the nearest one hundredth (0.01) of a gram for each test. This amount is recorded as the "original weight". The separate amounts of scale are then treated with 100 ml portions of the solvents. The solvent and scale mixtures are placed in an isothermal water bath at the temperatures and for the times given in Table II below.

A Gooch-type fritted disc filter is weighed to the nearest one hundredth (0.01) of a gram and this weight ("weight before") is recorded. At the end of the given time, the test mixture is filtered through the weighed filter and the filter is allowed to dry in a vacuum oven. The dry filter is reweighed ("weight after") and this weight is recorded.

In order to calculate the weight percent solubility, the following equations are used:

Weight Difference = Weight After minus Weight Before (The weight difference is the amount of insoluble scale that remains.)

Soluble Amount = Original Amount minus Weight Difference (The soluble amount is the amount of scale dissolved.)

Solubility (Wt.%) = (Soluble Amount/Original Weight) times 100

The results of these tests are given in Table II below.

TABLE II

Solubility of Black Liquor Evaporator Scale in Various Solvents

| Aqueous Solvent[1] | Scale Solubility (Wt. %) |
|---|---|
| 5.25% by weight NaClO[2] | 47 |
| 5.00% by weight $Ca(ClO)_2$[3] | 29 |
| 5.25% by weight NaClO + .06% by weight NaOH | 64 |
| 5.25% by weight NaClO + .2% by weight NaOH | 74 |
| 5.25% by weight NaClO + 1.0% by weight NaOH | 90 |
| 5.25% by weight NaClO + 2.0% by weight NaOH | 99 |
| 5.25% by weight NaClO + 2.0% by weight KOH | 79 |
| 2% by weight NaOH | Weight Gain |

[1]Each test was performed for 6 hours at 125° F. (51.7° C.) with 1 g of scale in 100 ml of solvent.
[2]The NaClO source was Clorox Bleach.
[3]The $Ca(ClO)_2$ used in this test was reagent grade.

From Table II it can be seen that the presence of an alkali metal hydroxide in the compositions of this invention increases the scale dissolution ability thereof and that the composition containing sodium hypochlorite and sodium hydroxide dissolved the greatest amount of scale.

What is claimed is:

1. A method of removing solid deposits from the surfaces of wood pulp processing apparatus said deposits being produced by the evaporation of black liquor in said apparatus said method consisting essentially in contacting said solid black liquor deposits with an aqueous solution consisting essentially of at least one alkali metal hypochlorite selected from the group consisting of sodium hypochlorite, potassium hypochlorite and mixtures thereof and at least one alkali metal hydroxide selected from the group consisting of sodium hydroxide, potassium hydroxide and mixtures thereof at a temperature and for a time sufficient to remove said deposits wherein said alkali metal hypochlorite is present in said solution in an amount in the range of from about 1 to about 10 percent by weight of said solution and said alkali metal hydroxide is present in said solution in the range of from about 0.05 to about 30 percent by weight of said solution.

2. The method of claim 1 wherein said alkali metal hypochlorite is sodium hypochlorite.

3. The method of claim 2 wherein said alkali metal hydroxide is sodium hydroxide.

4. The method of claim 3 wherein said sodium hypochlorite is present in said solution in an amount of about 5 percent by weight of said solution.

5. The method of claim 4 wherein said sodium hydroxide is present in said solution in an amount of about 2 percent by weight of said solution.

6. A method of removing solid black liquor deposits from the surfaces of wood pulp processing apparatus said method consisting essentially in circulating over said surfaces containing said solid black liquor deposits an aqueous solution consisting essentially of sodium hypochlorite present in said solution in an amount of about 5 percent by weight of said solution and sodium hydroxide present in said solution in an amount of about 2 percent by weight of said solution said circulating being conducted at a temperature in the range of ambient to the boiling point of said solution for a time sufficient to remove said deposits.

7. The method of claim 6 wherein said temperature is about 125° F.

8. The method of claim 7 wherein said time is about 6 hours.

* * * * *